United States Patent [19]

Plemmons et al.

[11] 4,379,321

[45] Apr. 5, 1983

[54] PLASTIC HEAVY-DUTY LUMINAIRE WITH DIRECT BALLAST CONNECTION

[75] Inventors: Jerry R. Plemmons, Asheville; Carl D. Taylor, Hendersonville, both of N.C.

[73] Assignee: General Electric Company, Schenectady, N.Y.

[21] Appl. No.: 232,709

[22] Filed: Feb. 9, 1981

[51] Int. Cl.[3] ..... F21Y 29/00

[52] U.S. Cl. ..... 362/267; 362/145; 362/217; 362/297; 362/310; 362/368; 362/370; 362/431

[58] Field of Search ..... 362/145, 217, 220, 225, 362/267, 297, 307, 310, 368, 370, 391, 426, 430, 431

[56] References Cited

U.S. PATENT DOCUMENTS

| | | | |
|---|---|---|---|
| 3,018,364 | 1/1962 | Wenman | 362/426 X |
| 3,661,685 | 5/1972 | Osteen | 362/431 X |
| 3,919,459 | 11/1975 | Van Steenhoven | 362/368 X |
| 4,019,044 | 4/1977 | Kelly et al. . | |
| 4,019,045 | 4/1977 | Bassett | 362/267 |
| 4,123,793 | 10/1978 | Lilley . | |
| 4,141,061 | 2/1979 | Ford et al. | 362/431 X |
| 4,156,889 | 5/1979 | Halberstadt et al. . | |
| 4,160,286 | 7/1979 | Merritt | 362/431 X |
| 4,200,905 | 4/1980 | Shelby et al. | 362/145 X |
| 4,234,912 | 11/1980 | Barnes et al. | 362/145 |

*Primary Examiner*—Peter A. Nelson

*Attorney, Agent, or Firm*—Ernest W. Legree; Philip L. Schlamp; Fred Jacob

[57] ABSTRACT

A heavy-duty luminaire comprises a housing assembly of plastics having good resistance to weathering or corrosion but capable of withstanding only low structural stress. The heavy electrical components are supported with a ballast compartment on a removable ballast tray which is attached to a main bracket. The main bracket receives its support directly from metal mounting means independently of the housing. The structural load on the plastic housing is limited substantially to its own weight plus that of a lightweight reflector assembly.

9 Claims, 5 Drawing Figures

3/3

PLASTIC HEAVY-DUTY LUMINAIRE WITH DIRECT BALLAST CONNECTION

The present invention relates to luminaires, and in particular concerns a heavy-duty luminaire or floodlight of enclosed type, suitable for outdoor lighting service such as street, highway and area lighting, and utilizing plastics for the housing.

BACKGROUND

Heavy-duty luminaires for outdoor service conventionally utilize a housing of die-cast aluminum. The use of plastic material in lighting fixtures has in general been limited to lightweight and light-duty applications utilizing low wattage lamps. This situation is one of long standing and the outdoor lighting industry almost automatically rejects plastic construction in favor of die-cast fabrication.

The plastic material most adaptable to fixture design is glass fiber-filled polyester resin commonly known as fiberglass. A fiberglass luminaire housing as compared to a die-cast housing is economical, and weathering and corrosive atmospheres are less of a problem. However, fiberglass cannot safely be used in electrical applications as a structural material for the support of heavy components, and Underwriter's Laboratories' regulations severely limit the stress to which it may be subjected. The result has been to substantially rule out up to the present, the use of plastics for the housings of luminaires which must contain heavy components such as iron core transformers and reactors.

SUMMARY OF THE INVENTION

The object of our invention is to provide an improved heavy-duty luminaire construction which takes advantage of the weathering and corrosion resistance of plastics for the housing and which supports heavyweight components within the housing without subjecting the plastic to structural stress.

A luminaire embodying our invention comprises a plastics housing having a ballast compartment and an optics compartment, and metal mounting means for securing the luminaire to a structural support. Within the ballast compartment a main metal bracket is provided through which all heavy components are supported and such main bracket is supported directly from the mounting means independently of the housing. The housing forms a weatherproof enclosure for all components and its structural role is limited substantially to supporting its own weight and the lightweight components of the optics compartment such as the reflector.

In a preferred embodiment, the housing has a bottom wall, a back wall, side walls and a front cover. The main bracket within the ballast compartment extends transversely along the back wall and has bent over arms extending toward the front along the side walls. A removable tray on which the heavy electrical components are mounted attaches to the main bracket. The main bracket may be supported from the mounting means through an external trunnion bracket having trunnion pins passing through the side walls of the housing and engaging the arms of the main bracket. Alternatively, the main bracket may be supported by an internal bracket having a portion extending along the bottom wall to which an external slipfitter is attached by fasteners going through the bottom wall of the housing. A lamp socket is attached to the reflector and a cover for the housing has a window in it facing the reflector.

DETAILED DESCRIPTION

Figure 1:
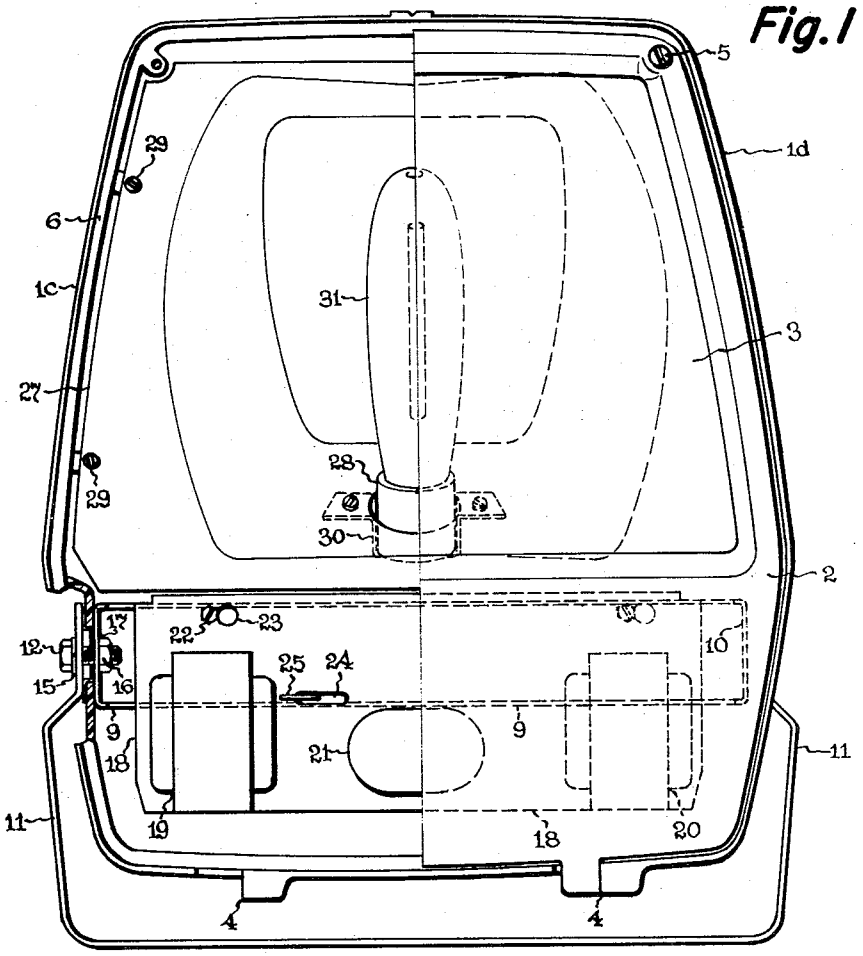
FIG. 1 is a front elevation view of a luminaire embodying the invention which uses an external trunnion bracket for mounting.
Figure 2:
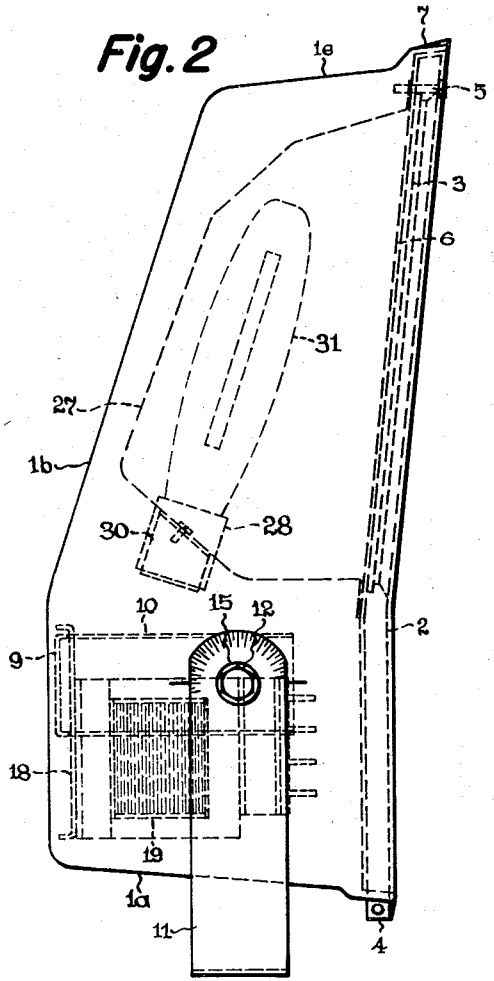
FIG. 2 is a side elevation corresponding to FIG. 1.

Referring now to the drawings wherein like symbols designate corresponding parts throughout the several views, there is illustrated in FIGS. 1 and 2 a luminaire embodying the invention comprising a plastics housing 1 of generally rectangular shape. It comprises bottom wall 1*a*, back wall 1*b*, side walls 1*c* and 1*d*, and top wall 1*e*. A suitable molding composition for the housing is one comprising roughly equal parts by weight of unsaturated polyester resin and short glass fibers. Such composition is introduced into a suitable mold and heated to cure the resin and produce the desired body of material commonly known as fiberglass. A cover or door 2 of which the left half has been cut away in FIG. 1, is made of the same plastic material and closes the front of the housing to the weather. The door is provided in its upper portion with a window 3 made of tempered, heat and shock-resistant glass or other suitable light-transmitting material; a clear window is illustrated but a lenticular or translucent one may also be used. The door is hinged to the housing at 4 and secured in the closed position by screws 5. When the door is closed, a rubber sealing gasket carried on its inner lip presses against the gasket surface 6 of the doorframe in the housing to effect a tight seal. In addition the housing has a drip shield 7 which extends out over the doorframe to shed water away from the gasket area between door and housing. The shapes of both housing and door include compound curves which stiffen the pieces to assure a better fit and reduced warpage in the assembly.

Figure 3:
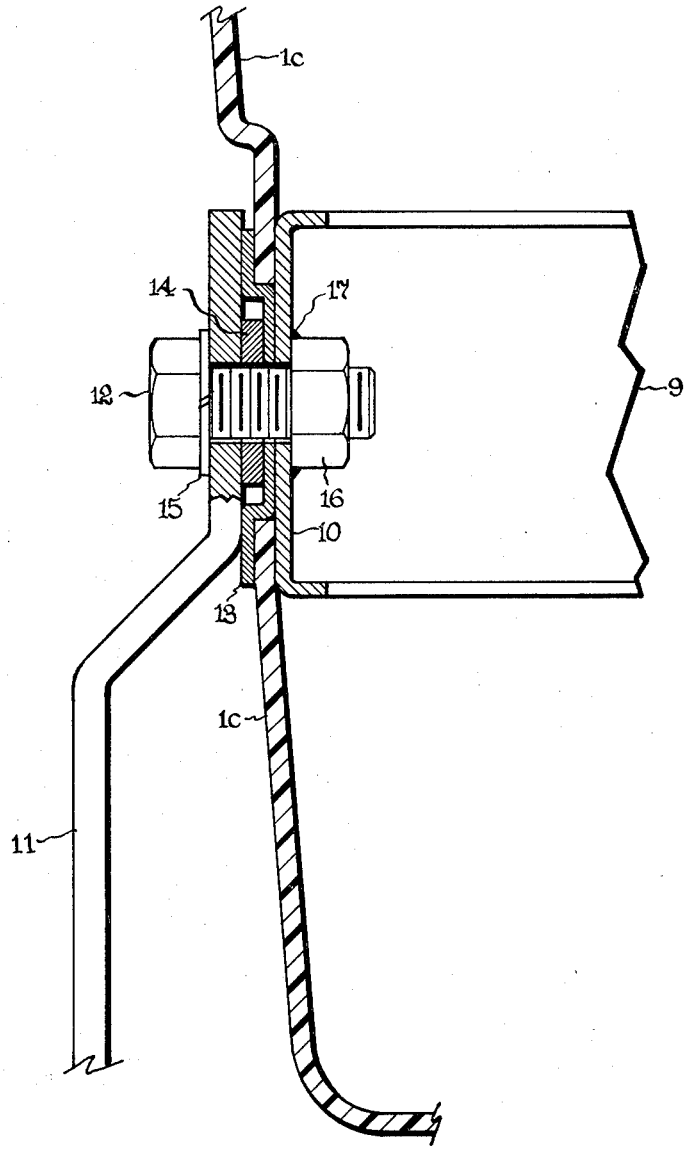
FIG. 3 is an enlarged cross-sectional view through the left trunnion assembly.

The ballast compartment occupies the lower portion, and the optics compartment, the upper portion of the housing. It will be understood that the term "compartment" as utilized herein, denotes a particular portion or space within the fixture which is given over to a certain function but which need not be isolated or partitioned off. In accordance with our invention, a main metal bracket 9 is provided within the ballast compartment through which all heavy components are supported directly from the mounting means and independently of the fiberglass housing. Main bracket 9 extends transversely along the back wall of the housing and has bent-over arms 10 extending toward the front along the side walls. The main bracket is supported through an external trunnion bracket 11 by means of trunnion bolts 12 at each end passing through the side walls 1*c* and 1*d* of the housing. As best seen in FIG. 3, the trunnion assembly also comprises a stepped washer 13 which is located by a snug fit in a hole through fiberglass wall 1*c* of the housing, a spacer washer 14 which is of the same thickness as the wall, a spring washer 15 and a nut 16 which is spot welded at 17 to arm 10. When the bolts 12 are tightened, the load is transferred directly from the main bracket through the metal parts of the trunnion assemblies to the trunnion bracket and thence to whatever structure the trunnion bracket may be fastened to. The combination of stepped washer 13 and spacer 14 prevent excessive compression loading of the fiberglass walls when the trunnion bolts are tightened to lock the floodlight in a given attitude.

The heavy electrical components of the luminaire are mounted on a ballast mounting means in the form of an elongated metal tray or plate 18 with edges rolled over for stiffness. Only the principal components are illustrated comprising an autotransformer 19, an inductive reactor 20 and a capacitor 21; the wiring and quick-release connectors between conductors have not been shown. One purpose of a component tray is to permit lightening the luminaire by removal of the tray during installation. Another purpose is to facilitate updating the light source used in the fixture. Because a new lamp design having higher efficiency or better color rendition may require a different operating circuit, it may be necessary to change ballast components before the new lamp can be enjoyed. This is readily accomplished with our luminaire design by opening the door, releasing the connectors, and loosening the two screws 22 by which the component tray is secured to the main bracket 9. The tray is then released by sliding it to the left so that the large holes of the keyhole slots 23 can pass over the screws 22, and then pulling the tray forward and out. Installing a new tray in the luminaire, a task which the workman may have to do from a ladder or precarious perch, is facilitated by accommodating in slot 24 of the tray the locating key blade 25 raised out of main bracket 9. The new tray is secured by reversing the sequence of steps followed in removal.

The optics compartment contains the reflector assembly comprising concave reflector 27 and lamp socket 28. Reflector 27 may suitably be a formed sheet of light gauge aluminum treated to have a highly reflecting specular surface. One suitable treatment is described in U.S. Pat. No. 3,499,780—Etherington et al and such treatment, when provided by applicant's assignee, is identified by the trademark Alglas. The reflector is attached to the housing by screws 29 penetrating bosses cast into the plastic housing. The socket 28 is fastened to a sheet metal bracket 30 attached to the underside of the reflector and projects partly into the reflector space.

The illustrated reflector is intended primarily for outdoor illumination and takes a vertically mounted lamp 31, here shown as a high pressure sodium vapor lamp. Our luminaire will accommodate other lamps and other reflector assemblies, for instance one providing a narrow beam distribution with a horizontal lamp, or another providing a wide beam distribution with a horizontal lamp. The reflector assembly is easily replaced by removing the screws 29 to allow the user to select another having a preferred optical distribution. A quick-disconnect connector (not shown) in the wiring interconnecting the lamp socket and the ballast components facilitates exchange of reflector assemblies.

In accordance with our invention, the structural load on the plastic housing is limited substantially to the reflector assembly plus of course the weight of the housing assembly itself which includes the door. The stepped washers 13 at the trunnions restrain the housing against translation relative to main bracket 9 but not against rotation. However an attachment is provided between the back wall of the housing and the main bracket which completes the restraint. The attachment is effected by screws 32 (illustrated in FIGS. 4 and 5) passing through the main bracket and engaging in bosses cast into the back wall. The stiffening ridges 32 molded into the back wall **1*b*** of the housing above and below the main bracket also serve to lock the housing to the bracket.

Figure 4:
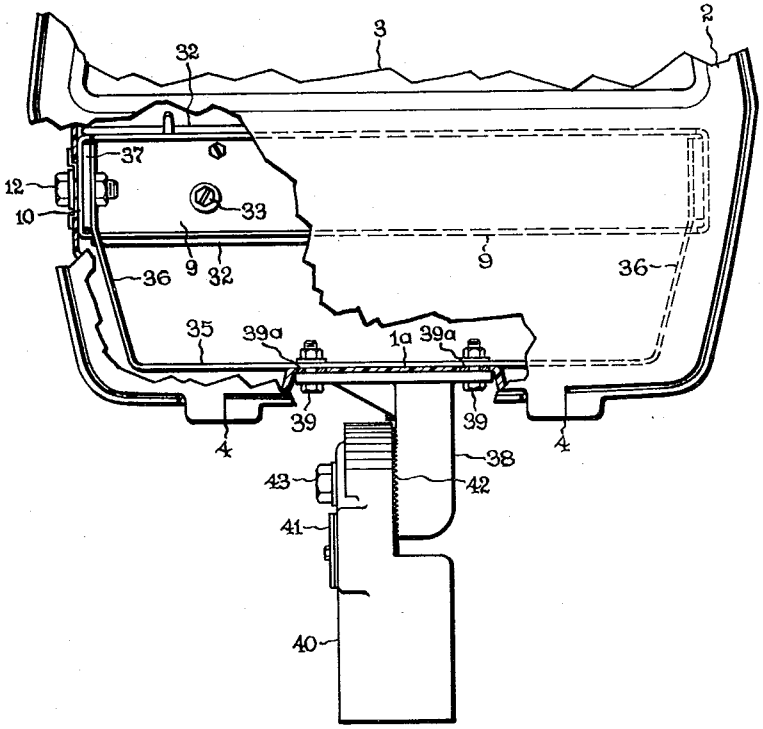
FIG. 4 is a fragmentary front elevation view of a similar luminaire using a slipfitter for mounting.
Figure 5:
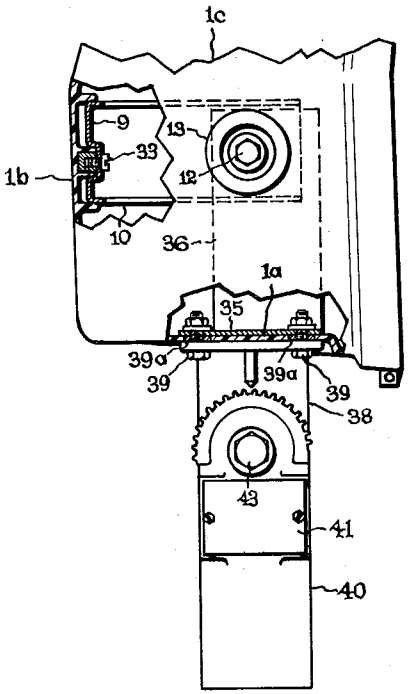
FIG. 5 is a side elevation corresponding to FIG. 4.

Referring to FIGS. 4 and 5, an alternate construction is illustrated utilizing a slipfitter for pole mounting of the luminaire. In this arrangement, the external trunnion bracket is replaced by an internal bracket 35 which has a clamping portion extending along the bottom wall **1*a*, and bent-up arms 36 reaching up to arms 10 of main bracket 9. The same trunnion bolts 12 and stepped washers 13 together with spacer washers 37 are used to clamp the arms 10 and 36 together and thereby affix the brackets together. The upper section 38 of the slipfitter terminates in an attachment plate which is bolted at 39 through the bottom wall 1*a* to the clamping portion of internal bracket 35. Metal washers 39*a* corresponding in thickness to the plastic wall 1*a* serve as spacers and prevent undesirable compression loading of the plastic. The pole section 40 of the slipfitter contains a wiring box accessible under removable cover 41 within which line connections may be made. The mating faces of the two sections of the slipfitter are serrated at 42 to facilitate clamping by bolt 43** after the luminaire has been properly aimed.

In the slipfitter luminaire of FIGS. 4 and 5, the illustrated internal bracket 35 permits the use of the identical main bracket 9 and trunnion bolts and washers used in the trunnion luminaire of FIGS. 1 and 2. This has the advantage of reducing the number of parts required to be carried in inventory. It will be apparent however that a different simpler arrangement could be used in which the main bracket and the internal bracket are combined into a single member. Such member would comprise the transverse portion of the main bracket extending along the back wall plus a central arm extending as the leg of a T down the back wall, then along the bottom wall, and terminating in a clamping plate overlying the attachment plate of the slipfitter. The bent-over arms 10 of the main bracket are eliminated and the holes in the side walls of the housing through which the trunnion bolts extended are also eliminated.

The invention thus provides a heavy-duty luminaire or flood light construction in which plastics having superior resistance to weathering or corrosive atmospheres are used for a housing enclosing or shielding all components while metal structural parts support heavy-weight components independently of the housing. We have described our invention with reference to specific embodiments, but numerous modifications may be made without actually departing from the scope of the invention and the appended claims are intended to cover all such equivalent variations.

What we claim as new and desire to secure by Letters Patent of the United States is:

1. A luminaire comprising:

a housing assembly of plastics having good resistance to weathering or corrosion but capable of withstanding only low structural stress, said assembly providing a weatherproof enclosure for a ballast compartment and an optics compartment, metal mounting means for securing to a structural support, a main metal bracket within the ballast compartment for the support of heavy electrical components, said main bracket being supported directly from said mounting means independently of the housing assembly, a reflector within the optics compartment attached to said housing assembly and means fastening said housing assembly to said mounting means.

2. A luminaire as in claim 1 including a removable ballast mounting means on which electrical components for controlling energization of a lamp are mounted, said ballast mounting means being adapted to be inserted into said ballast compartment and releasably secured to said main metal bracket.

3. A luminaire as in claim 2 wherein the housing assembly comprises a housing and a weathertight cover therefor which opens for access to the ballast mounting means.

4. A luminaire comprising:

a plastics housing having bottom, back, and side walls defining a ballast compartment and an optics compartment, a main bracket having a portion extending transversely along the back wall, heavy electrical components secured to the front of said portion and supported in said ballast compartment, metal mounting means for attaching said luminaire to a structural support, metal fasteners extending through at least one wall of said housing and supporting said main bracket directly from said mounting means, a reflector within the optics compartment and a lamp socket for supporting a lamp within the reflector, said reflector being affixed to said housing, a door closing the front of said housing and having a window facing the optics compartment, and means securing said housing to said mounting means.

5. A luminaire as in claim 4 wherein the means securing said housing to said mounting means comprise, besides said metal fasteners extending through at least one wall of said housing, an attachment between the back wall of the housing and the main bracket.

6. A luminaire as in claim 4 including a removable ballast tray on which electrical components for controlling energization of a lamp accommodated within said socket are mounted, said tray being adapted to be inserted into said ballast compartment when the door is open and releasably secured to said main bracket.

7. A luminaire as in claim 4 wherein said main bracket has arms extending from the transverse portion toward the front along the side walls, said mounting means comprise an external trunnion bracket overlapping said arms at opposite side walls, and said metal fasteners comprise trunnion pins extending from said trunnion bracket through said side walls and engaging said arms.

8. A luminaire as in claim 4 wherein the main bracket includes a clamping portion extending along the bottom wall of the housing, said mounting means comprise a slipfitter including an upper section terminating in an attachment plate laid against said bottom wall, and said metal fasteners extend from said attachment plate through said bottom wall to the clamping portion of said internal bracket.

9. A luminaire as in claim 4 wherein said main bracket has arms extending from the transverse portion toward the front along the side walls, an internal bracket comprises a clamping portion extending along the bottom wall of the housing and bent up arms reaching up to the arms of the main bracket, means fasten each arm of the internal bracket to the corresponding arm of the main bracket, said mounting means comprise a slipfitter including an upper section terminating in an attachment plate laid against said bottom wall, and said metal fasteners extend from said attachment plate through said bottom wall to the clamping portion of said internal bracket.

* * * * *